US007390073B2

(12) United States Patent
Bailey et al.

(10) Patent No.: US 7,390,073 B2
(45) Date of Patent: Jun. 24, 2008

(54) METHOD AND APPARATUS FOR PERFORMING ALIGNMENT FOR PRINTING WITH A PRINTHEAD

(75) Inventors: Thomas A. Bailey, Lexington, KY (US); Michael A. Penrod, Lexington, KY (US); Zanyao Yan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 438 days.

(21) Appl. No.: 11/192,928

(22) Filed: Jul. 29, 2005

(65) Prior Publication Data

US 2007/0024660 A1 Feb. 1, 2007

(51) Int. Cl.
*B41J 29/393* (2006.01)
*B41J 29/38* (2006.01)

(52) U.S. Cl. ..... 347/19; 347/12

(58) Field of Classification Search ..... 347/19
See application file for complete search history.

(56) References Cited

U.S. PATENT DOCUMENTS 5,121,196 A 6/1992 Hung
6,072,917 A 6/2000 Mori et al.
6,076,915 A * 6/2000 Gast et al. ..... 347/19
6,198,896 B1 3/2001 Nakayasu et al.
6,404,517 B1 6/2002 Chao
6,408,156 B1 6/2002 Miyazaki et al.
6,450,607 B1 * 9/2002 Bolash et al. ..... 347/19
6,554,390 B2 4/2003 Arquilevich et al.
6,561,613 B2 5/2003 Cunnagin et al.
6,582,050 B2 6/2003 Akiyama
6,582,052 B2 6/2003 Sarmast et al.
6,595,613 B2 * 7/2003 Fujimori ..... 347/14
6,623,096 B1 9/2003 Castano et al.
6,672,701 B1 * 1/2004 Nunokawa ..... 347/19
6,832,824 B1 12/2004 Baker et al.
2004/0165033 A1 * 8/2004 Chikuma et al. ..... 347/41
2006/0274107 A1 * 12/2006 Anderson et al. ..... 347/20

* cited by examiner

*Primary Examiner*—Matthew Luu
*Assistant Examiner*—Shelby Fidler
(74) *Attorney, Agent, or Firm*—Taylor & Aust, P.C.

(57) ABSTRACT

A method of performing alignment for printing with a printhead includes bidirectionally printing a plurality of rows of alignment blocks, wherein a bidirectional offset of a plurality of bidirectional offsets is different for each row of the alignment blocks; optically measuring each row to obtain measurement data; determining a statistical data value for each row based on the measurement data; and applying a respective bidirectional offset of the plurality of bidirectional offsets corresponding to a row having the lowest statistical data value of the plurality of rows to align the printhead for printing with the printhead.

28 Claims, 8 Drawing Sheets

METHOD AND APPARATUS FOR PERFORMING ALIGNMENT FOR PRINTING WITH A PRINTHEAD

BACKGROUND OF THE INVENTION

1. Field of the Invention.

The present invention relates to imaging, and, more particularly, to a method and apparatus for performing alignment for printing with a printhead.

2. Description of the Related Art.

Aligning a printhead is a significant factor in the resultant image quality of an inkjet imaging apparatus. Alignment is needed because of several factors such as mechanical tolerances in the printhead manufacturing process and the imaging apparatus manufacturing process as well as the differences in behavior of each of the ink drops from each of the different colorants relative to one another. Current methods of alignment measure distances between lines and feed that information to the software on the host computer and software resident in the imaging apparatus to make compensations on incoming print swath data to get the best image quality reproduction possible for the device. Although such methods may be suitable for printing text and business graphics, they may not provide suitable results for printing images such as photographs.

What is needed in the art is an improved method and apparatus for performing alignment for printing with a printhead

SUMMARY OF THE INVENTION

The present invention provides a method and apparatus for performing alignment for printing with a printhead.

The invention, in one exemplary embodiment thereof, relates to a method of performing alignment for printing with a printhead. The method includes bidirectionally printing a plurality of rows of alignment blocks, wherein a bidirectional offset of a plurality of bidirectional offsets is different for each row of the alignment blocks; optically measuring each row to obtain measurement data; determining a statistical data value for each row based on the measurement data; and applying a respective bidirectional offset of the plurality of bidirectional offsets corresponding to a row having the lowest statistical data value of the plurality of rows to align the printhead for printing with the printhead.

The invention, in another exemplary embodiment thereof, relates to an imaging apparatus configured for performing alignment for printing with a printhead of the imaging apparatus. The imaging apparatus includes a printer portion configured to mount the printhead, at least one of a scanner portion and a sensor; and a controller communicatively coupled to the printer portion and the at least one of the scanner portion and the sensor. The controller is configured to execute instructions for bidirectionally printing a plurality of rows of alignment blocks using the printhead, wherein a bidirectional offset of a plurality of bidirectional offsets is different for each row of the alignment blocks; optically measuring each row using the at least one of the scanner portion and the sensor to obtain measurement data; determining a statistical data value for the each row based on the measurement data; and applying a respective bidirectional offset of the plurality of bidirectional offsets corresponding to a row having the lowest statistical data value of the plurality of rows to align the printhead for printing with the printhead.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
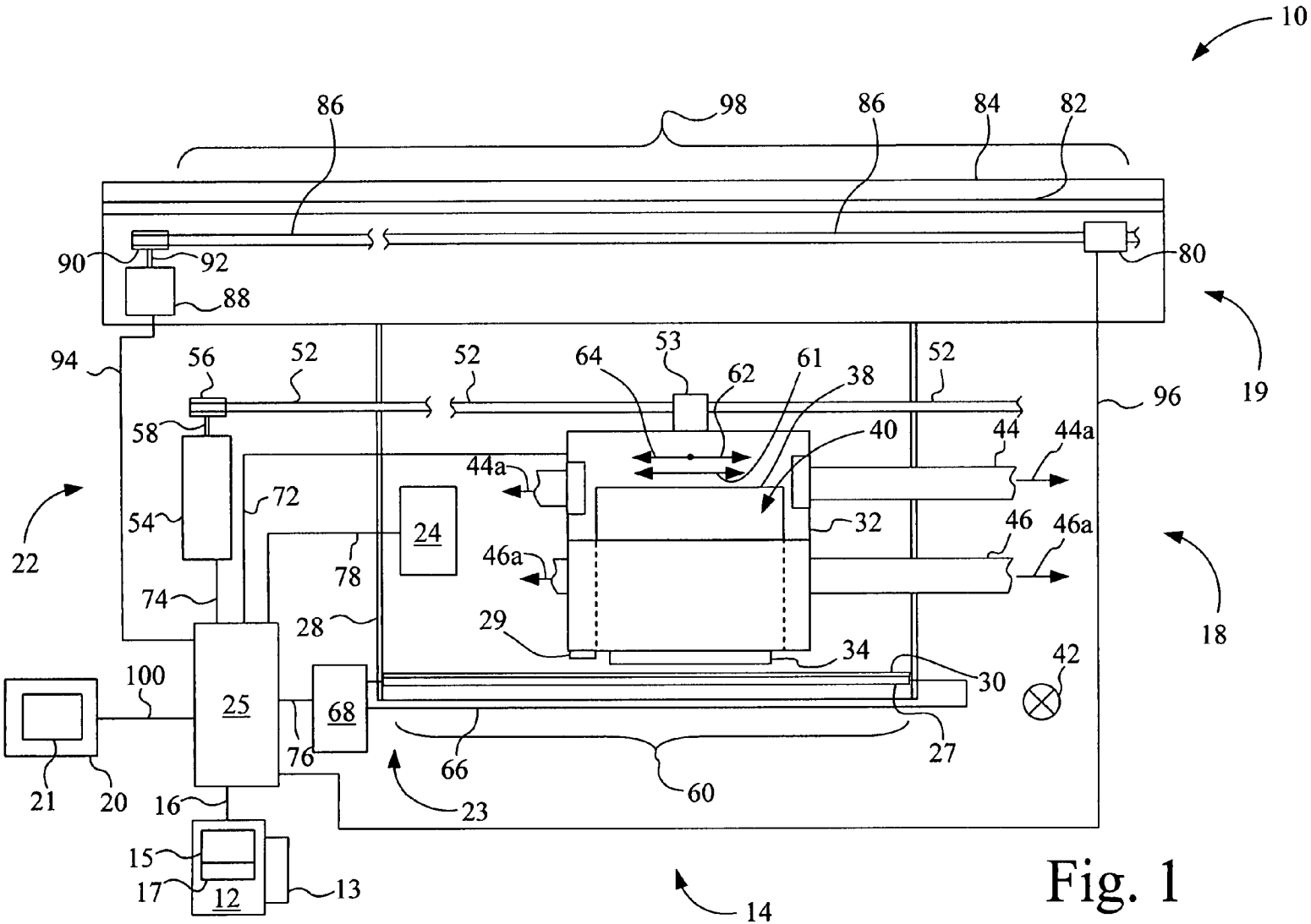
FIG. 1 is a diagrammatic representation of an imaging system embodying the present invention.

Referring now to the drawings, and particularly to FIG. 1, there is shown an imaging system 10 embodying the present invention. Imaging system 10 may include a host 12, or alternatively, imaging system 10 may be a standalone system.

Imaging system 10 includes an imaging apparatus 14, which may be in the form of, for example, a printer, or a multi-function apparatus such as but not limited to a standalone unit that has faxing and copying capability, in addition to printing.

Host 12, which may be optional, may be communicatively coupled to imaging apparatus 14 via a communications link 16. Communications link 16 may be, for example, a direct electrical connection, a wireless connection, or a network connection.

In embodiments including host 12, host 12 may be, for example, a personal computer including a display device, such as display monitor 13, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as an imaging driver 15 for imaging apparatus 14. Imaging driver 15 is in communication with imaging apparatus 14 via communications link 16. Imaging driver 15 includes a data formatter 17 that places print data and print commands in a format that can be recognized by imaging apparatus 14, and also includes a halftoning unit. In a network environment, communications between host 12 and imaging apparatus 14 may be facilitated via a standard communication protocol, such as the Network Printer Alliance Protocol (NPAP).

In the present embodiment, imaging apparatus 14 includes a printer portion 18, a scanner portion 19, and a user interface 20 with display 21. As used herein, scanner portion 19 relates to a scanner that is adapted for use in performing bi-directional alignment in accordance with an embodiment of the present invention, for example, a conventional flat-bed scanner that is also used for scanning documents and images. However, it is not necessary that scanner portion take the form of a flat-bed scanner.

Printer portion 18 includes a printhead carrier system 22, a feed roller unit 23, a sheet picking unit 24, a controller 25, a mid-frame 27, a media source 28, and a sensor 29. As used herein, sensor 29 relates to an optical sensor, for example, including light emitting and light receiving portions. Sensor 29 is capable of sensing ink deposited on print media, and provides, for example, reflectance data in the form of milli-Volt output to controller 25 for use in performing bidirectional alignment in accordance with an embodiment of the present invention.

Media source 28 is configured to receive a plurality of print media sheets from which a print medium, e.g., a print media sheet 30, is picked by sheet picking unit 24 and transported to feed roller unit 23, which in turn further transports print media sheet 30 during a printing operation. Print media sheet 30 can be, for example, plain paper, coated paper, photo paper or transparency media.

Printhead carrier system 22 includes a printhead carrier 32 for mounting and carrying a printhead 34. Printhead 34 is configured to print using a plurality of colorants. An ink reservoir 38 is provided in fluid communication with printhead 34 for providing a plurality of colorants to printhead 34 for printing, for example, cyan, magenta, and yellow (CMY) inks. Those skilled in the art will recognize that printhead 34 and ink reservoir 38 may be formed as individual discrete units, or may be combined as an integral unitary printhead cartridge 40. Although a single printhead 34 is employed in the embodiment described, it will be understood that any combination of one, two, or more printheads of the same or different colors or combinations of colors may be employed without departing from the scope of the present invention. In the present embodiment, printhead 34 employs nozzles for printing two drop sizes, e.g., "big" drops and "small" drops, respectively. It will be appreciated that any number of drop sizes or ink concentrations or compositions may be employed without departing from the scope of the present invention.

During normal operation, print media is fed into imaging apparatus 14 in a media feed direction 42, also referred to as the y-axis, designated as an X in a circle to indicate that media feed direction 42 is perpendicular to the plane of FIG. 1. In performing printing, printhead 34 is transported in a direction perpendicular to media feed direction 42 as set forth below.

As shown in FIG. 1, printhead carrier 32 is guided by a guide member 44 and a guide rod 46. Each of guide member 44 and guide rod 46 includes a respective horizontal axis 44*a*, 46*a*. The horizontal axis 46*a* of guide rod 46, also sometimes referred to herein as a scan axis 46*a* or X-axis 46*a*, generally defines a bi-directional scanning path for printhead carrier 32. Accordingly, the bi-directional scanning path is associated with printhead 34.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 25, printhead carrier 32 is translated in a reciprocating manner along guide member 44 and guide rod 46. Carrier motor 54 can be, for example, a direct current (DC) motor or a stepper motor.

The reciprocation of printhead carrier 32 transports ink jet printhead 34 and sensor 29 across the print media sheet 30 along X-axis 46*a* to define a print zone 60 of imaging apparatus 14. The reciprocation of printhead carrier 32 occurs in a main scan direction 61 (bi-directional) that is parallel with X-axis 46*a*, and is commonly referred to as the horizontal direction. The horizontal main scan direction 61 includes a forward scan direction 62 and a reverse scan direction 64. Generally, during each scan of printhead carrier 32 while printing, the print media sheet 30 is held stationary by feed roller unit 23.

Mid-frame 27 provides support for print media sheet 30 when print media sheet 30 is in print zone 60, and in part, defines a portion of a print media path of imaging apparatus 14.

Feed roller unit 23 includes a feed roller 66 and corresponding index pinch rollers (not shown). Feed roller 66 is driven by a drive unit 68. The index pinch rollers apply a biasing force to hold print media sheet 30 in contact with respective driven feed roller 66. Drive unit 68 includes a drive source, such as a stepper motor, and an associated drive mechanism, such as a gear train or belt/pulley arrangement. Feed roller unit 23 feeds print media sheet 30 in a direction parallel to media feed direction 42. The media feed direction 42 is commonly referred to as the vertical direction, which is perpendicular to the horizontal bi-directional scanning path, and in turn, perpendicular to the horizontal forward and reverse carrier scan directions 62, 64. Thus, with respect to print media sheet 30, carrier reciprocation occurs in a horizontal direction and media advance occurs in a vertical direction, and the carrier reciprocation is generally perpendicular to the media advance.

Controller 25 includes a microprocessor having an associated random access memory (RAM) and read only memory (ROM). Controller 25 may be a printer controller, a scanner controller, or may be a combined printer and scanner controller, for example, such as for use in a copier or a multifunction unit. In the present embodiment, controller 25 is a combined printer and scanner controller capable of controlling both printer portion 18 and scanner portion 19 of imaging apparatus 14. Although controller 25 is depicted as residing in imaging apparatus 14, alternatively, it is contemplated that all or a portion of controller 25 may reside in host 12, for example, as part of imaging driver 15. Nonetheless, as used herein, controller 25 is considered a part of imaging apparatus 14, as is imaging driver 15.

Controller 25 executes program instructions to effect the printing of an image on print media sheet 30, such as for example, by selecting the index feed distance of print media sheet 30 along the print media path as conveyed by feed roller 66, controlling the reciprocation of printhead carrier 32, and controlling the operations of printhead 34.

Controller 25 also executes instructions to effect the scanning of an item by scanner portion 19, for example, a document or an image, and extracts image data pertaining to the scanned item that may be used to reproduce a likeness of the item using, for example, display monitor 13 and/or printer portion 18. In addition, controller 25 executes instructions to scan an item using sensor 29, which is attached to and carried by printhead carrier 32.

Controller 25 is electrically connected and communicatively coupled to printer portion 18 including printhead 34 via a communications link 72, such as for example a printhead interface cable. Controller 25 is electrically connected and communicatively coupled to carrier motor 54 via a communications link 74, such as for example an interface cable. Controller 25 is electrically connected and communicatively coupled to drive unit 68 via a communications link 76, such as for example an interface cable. Controller 25 is electrically connected and communicatively coupled to sheet picking unit 24 via a communications link 78, such as for example an interface cable.

Printhead 34 may include at least two sizes of nozzles, for example, large nozzles and small nozzles, or alternatively may include nozzles all of which being of substantially the same size. In the present embodiment, printhead 34 includes both large and small nozzles.

Scanner portion 19 of imaging apparatus 14 includes a scan bar 80, a scan-bed 82 and a cover 84.

Scanner portion 19 and printer portion 18 are each configured for operation independent of the other, such that, for example, scanner portion 19 may perform scanning while printhead carrier system 22 and printhead 34 remain stationary in printer portion 18.

Scan bar 80 is connected to a scan bar transport belt 86 that is driven by a scanner motor 88 via a scanner pulley 90. Scanner motor 88 has a rotating scanner motor shaft 92 that is attached to scanner pulley 90. Scanner motor 88 can be, for example, a direct current (DC) motor or a stepper motor, and is controlled by controller 25, which is electrically connected and communicatively coupled to scanner portion 19 via a communications link 94, such as for example an interface cable.

At the directive of controller 25, scan bar 80 is translated in a reciprocating manner along scan-bed 82 to obtain image data from a document or image that rests on scan-bed 82. Image data obtained by scan bar 80 is fed into controller 25, which is electrically connected to and communicatively coupled to scan bar 80 via a communications link 96, such as for example an interface cable. The image data may include, for example, gray level data, green channel data, e.g., the green channel output by an RGB scanner, luminance, and/or hue data. Cover 84 retains the document or image in place during scanning operations. The reciprocation of scan bar 80 across scan-bed 82 defines a scanning zone 98 of scanner portion 19 of imaging apparatus 14.

User interface 20 and display 21 are connected to controller 25 via a communications link 100, such as for example an interface cable. User interface 20 and display 21 are used, for example, to receive user input and commands, and to provide status, printing or scanning options, instructions, and/or other information to the user of imaging apparatus 14 for use in operating printer portion 18 and scanner portion 19 of imaging apparatus 14.

In order for imaging apparatus 14 to provide optimal print output, a bi-directional alignment must also be performed for printhead 34. The bidirectional alignment may include one or both of a horizontal bidirectional alignment and a vertical bidirectional alignment.

The horizontal bidirectional alignment of printhead 34 pertains to adjusting the effective timing at which the ink is to be ejected from the nozzles such that the ejected ink drops will land in designated locations on print media sheet 30 without regard to the direction of transport of printhead 34, e.g., left-to-right carrier scan direction 62 or right-to-left carrier scan direction 64, and compensates for a time-of-flight delay between when an ink nozzle is fired and when the ink drop lands on print media sheet 30.

The vertical bidirectional alignment of printhead 34 pertains to accounting for differences in nozzle bank output, for example, as between nozzles banks of the same or different ink colors of printhead 34. For example, one or more nozzle banks may be skewed or offset in media feed direction 42 relative to other nozzle banks. Accordingly, it may be desirable to adjust the position of the print media when printing with such nozzle banks so as to account for the position of the skewed or offset nozzle banks. For example, in a forward pass of bidirectional printing certain nozzle banks may be employed to print the desired data, and the print media may be indexed a small amount, e.g., a fraction of the nozzle spacing of printhead 34, so that the dots printed in the reverse pass are properly located with respect to the dots printed in the forward pass, e.g., not overlapping the dots printed in the forward pass to an unacceptable degree.

When printing with a bidirectionally aligned printhead 34, ink dots are placed on print media sheet 30 in a desired pattern by ejecting ink in a forward pass, i.e., in forward scan direction 62 and by ejecting ink in a reverse pass, i.e., in reverse scan direction 64. For example, in the forward pass, dots are placed as required by the input image data on a grid, leaving spaces for the dots to be printed in the reverse pass. The dots are then placed in the reverse pass as required by the input image data.

Figure 2A:
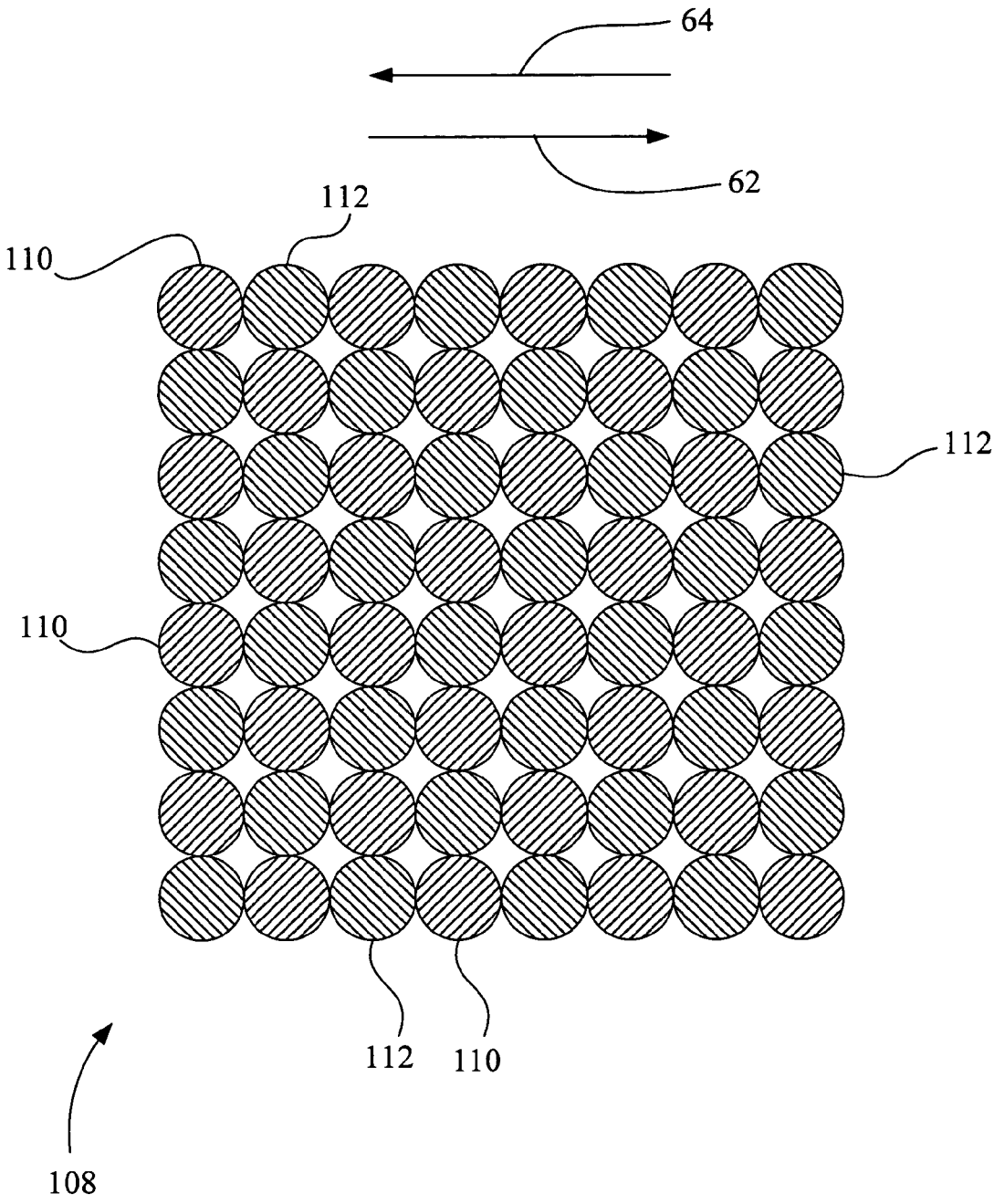
FIGS. 2A-2C illustrate dot patterns used in explaining bidirectional alignment.
Figure 2B:
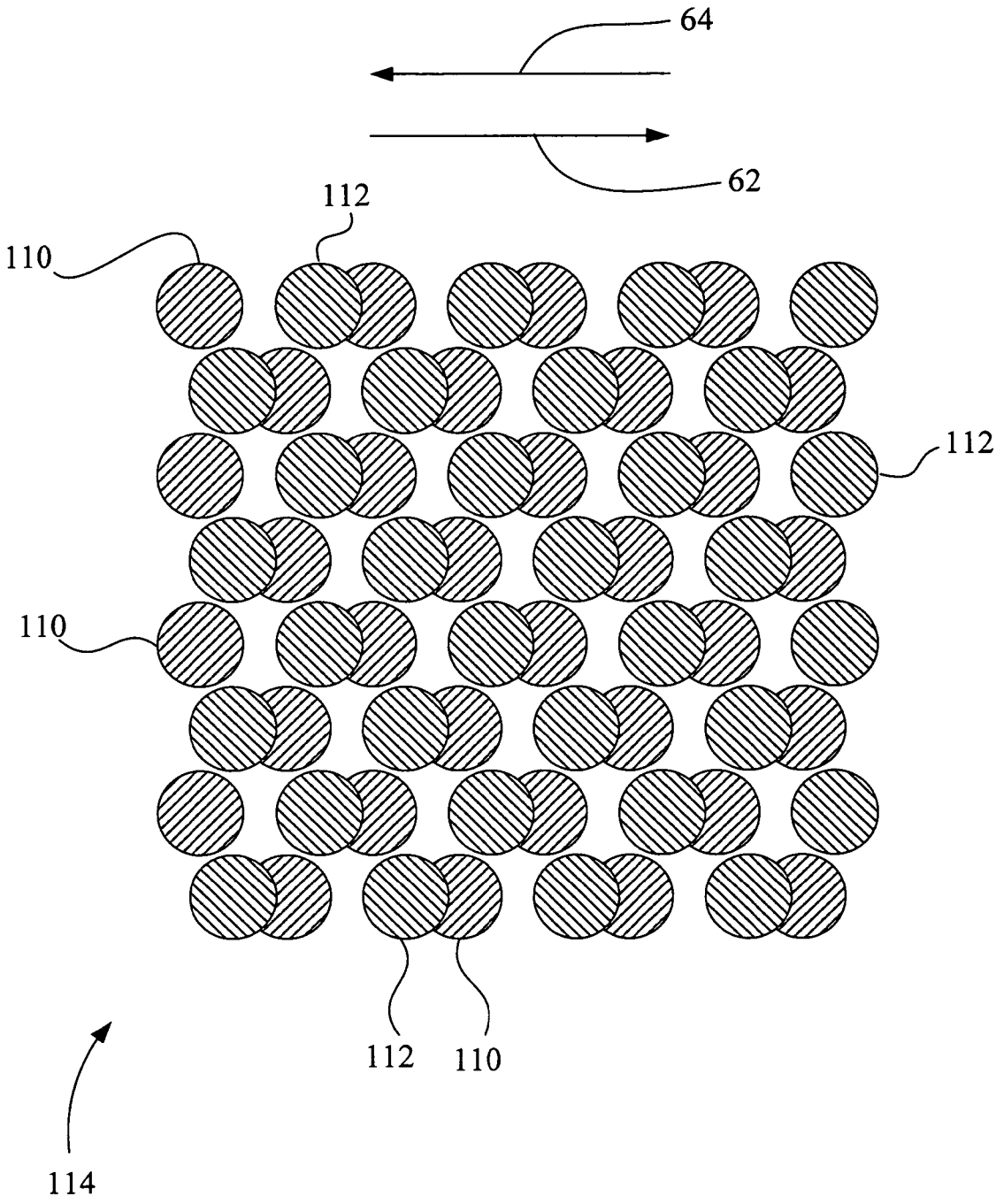
Figure 2C:
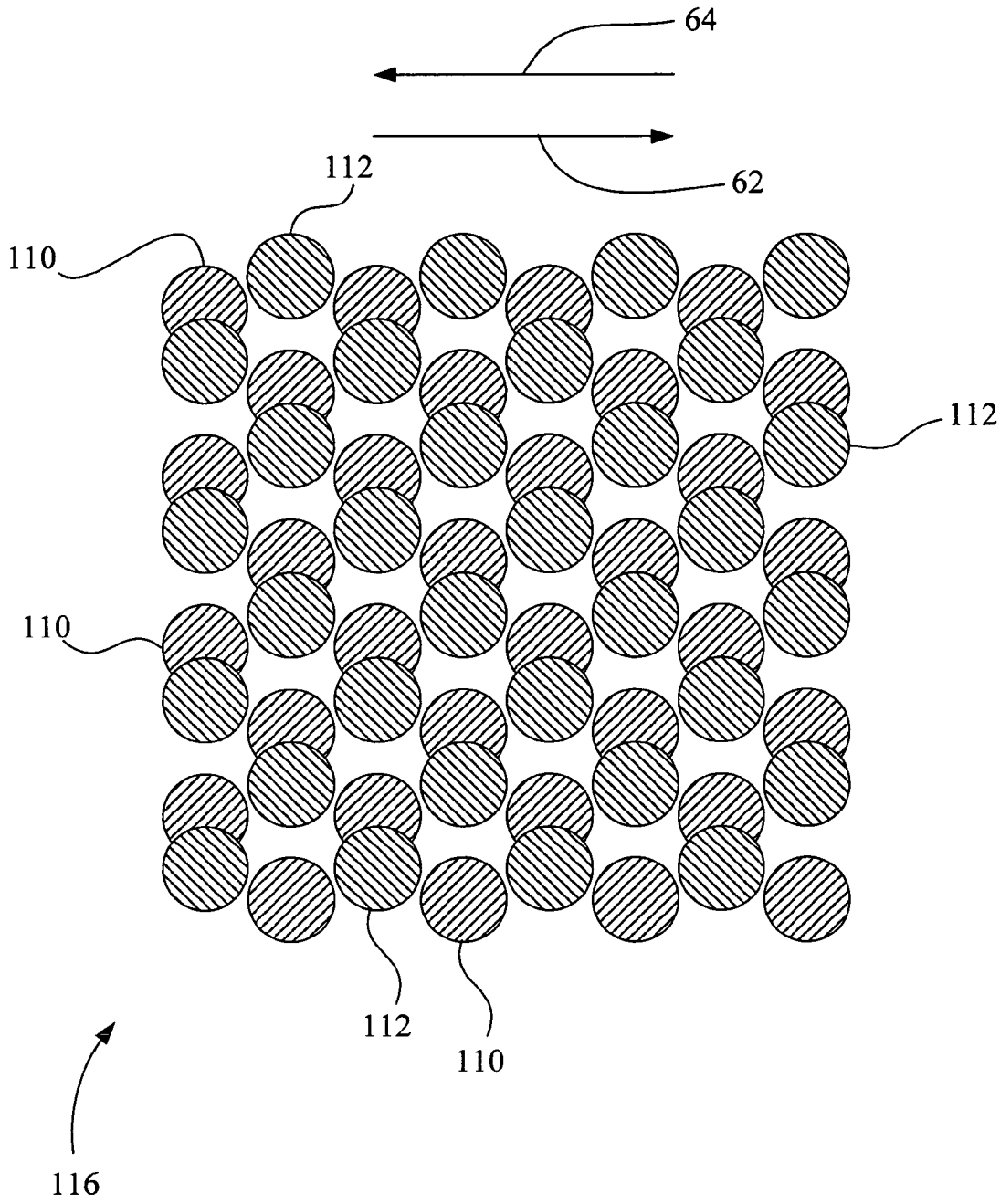

Referring now to FIGS. 2A-2C, different bidirectional alignment conditions are depicted. For example, in FIG. 2A, a dot pattern 108 printed by a bidirectionally aligned printhead 34 is illustrated. The dot patterns of FIG. 2A, as well as those of FIGS. 2B and 2C, are exemplary only, and intended only to illustrate the effects of and the need for bidirectional alignment.

In FIG. 2A, dots 110 printed in the forward pass are those having the diagonal cross-hatch with the positive slope, whereas dots 112 printed in the reverse pass are those dots having the diagonal cross-hatch with the negative slope. It is seen that dots 110 and dots 112 are adjacent to each other in both the vertical and horizontal directions.

Referring now to FIG. 2B, a dot pattern 114 having a horizontal bidirectional misalignment is depicted. It is seen in FIG. 2B that dots 112 printed in the reverse direction (diagonal cross-hatch with the negative slope) are offset horizontally relative to dots 110 printed in the forward direction (diagonal cross-hatch with the positive slope), leaving white spaces between the dots. This horizontal offset is undesirable, as it contributes to a grainy appearance of the final printed image, and adversely affects the luminance and hue of the image, e.g., due to the white spaces between the printed dots, and due to the overlap of the dots, respectively, resulting in an undesirable deviation from the original input image sought to be reproduced using imaging apparatus 14. In order to rectify the deviation, it is desirable to apply a horizontal bidirectional offset that adjusts the position of the dots so that dots 110 and dots 112 are located as desired relative to each other so as to minimize the amount of white space between the dots. In the present embodiment, a horizontal bidirectional offset is applied to the reverse pass, which shifts the timing of the ink ejections so that the dots printed in the reverse pass land at the desired locations on the print media, for example, as exemplarily depicted in FIG. 2A. Alternatively, however, it is contemplated that a horizontal bidirectional offset may be applied to the forward pass, or to both the forward and reverse passes, which would similarly rectify the deviation.

Referring now to FIG. 2C, a dot pattern 116 having a vertical bidirectional misalignment is depicted. It is seen in FIG. 2C that dots 112 printed in the reverse direction (diagonal cross-hatch with the negative slope) are offset vertically relative to dots 110 printed in the forward direction (diagonal cross-hatch with the positive slope), leaving white spaces between the dots. This vertical offset is undesirable, as it contributes to a grainy appearance of the final printed image, and adversely affects the luminance and hue of the image, similar to that of the horizontal bidirectional misalignment as set forth above. In order to rectify the deviation, it is desirable to apply a vertical bidirectional offset that adjusts the position of the dots so that dots 110 and dots 112 are located as desired relative to each other so as to minimize the amount of white space between the dots. For example, a vertical bidirectional offset may applied to the reverse pass, which shifts the position of the print medium when printing in the reverse scan direction 64 so that the dots printed in the reverse pass land at the desired locations on the print media, for example, as exemplarily depicted in FIG. 2A. Alternatively, however, it is contemplated that a vertical bidirectional offset may be applied to the forward pass, or to both the forward and reverse passes, which would similarly rectify the deviation.

Imaging apparatus 14 has programmed therein default bidirectional offsets that may be used for printing. However, due to mechanical tolerances in imaging apparatus 14 and printhead 14, as well as variations in ink drop velocity as ejected from printhead 34, relative to a standard value, and other printhead 34 performance characteristics, the default bidirectional offsets may not be sufficient to attain the highest print quality achievable by imaging apparatus 14. Accordingly, it is desirable to perform a bidirectional alignment of printhead 34 for optimal printing.

Set forth below are embodiments of the present invention that perform bidirectional alignment without detecting the edges of the objects scanned in order to perform the alignment. The present invention method of alignment is more robust than edge detection techniques, because a larger area is analyzed for any errors. Edge detection is essential for good text and business graphics printing, but does not perform as well for photographic printing. In addition, because multiple colors of ink are employed, the present invention method essentially gives an average alignment between the colorants of printhead 34, without relying on or otherwise employing edge detection.

Figure 3:
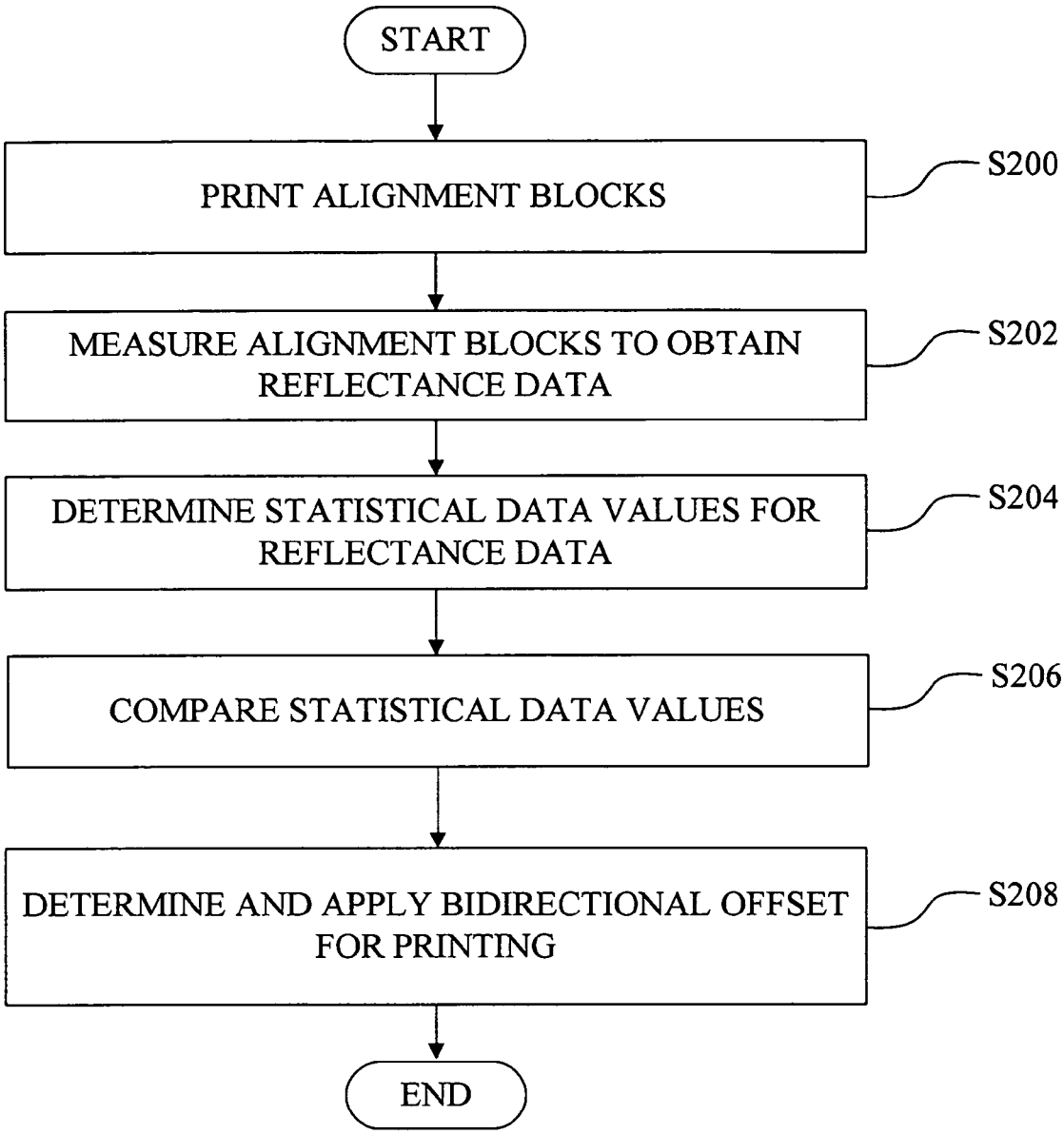
FIG. 3 is a flowchart depicting a method of performing alignment for printing with a printhead in accordance with an embodiment of the present invention.

Referring now to FIG. 3, a method of performing alignment for printing with printhead 34 in accordance with an embodiment of the present invention is depicted in the form of a flowchart, as with respect to steps S200-S208. Controller 25 executes instructions to perform each step, as follows.

At step S200 a plurality of rows of alignment blocks 102 are bidirectionally printed, wherein a bidirectional offset of a plurality of bidirectional offsets is different for each row of the alignment blocks.

Figure 4:
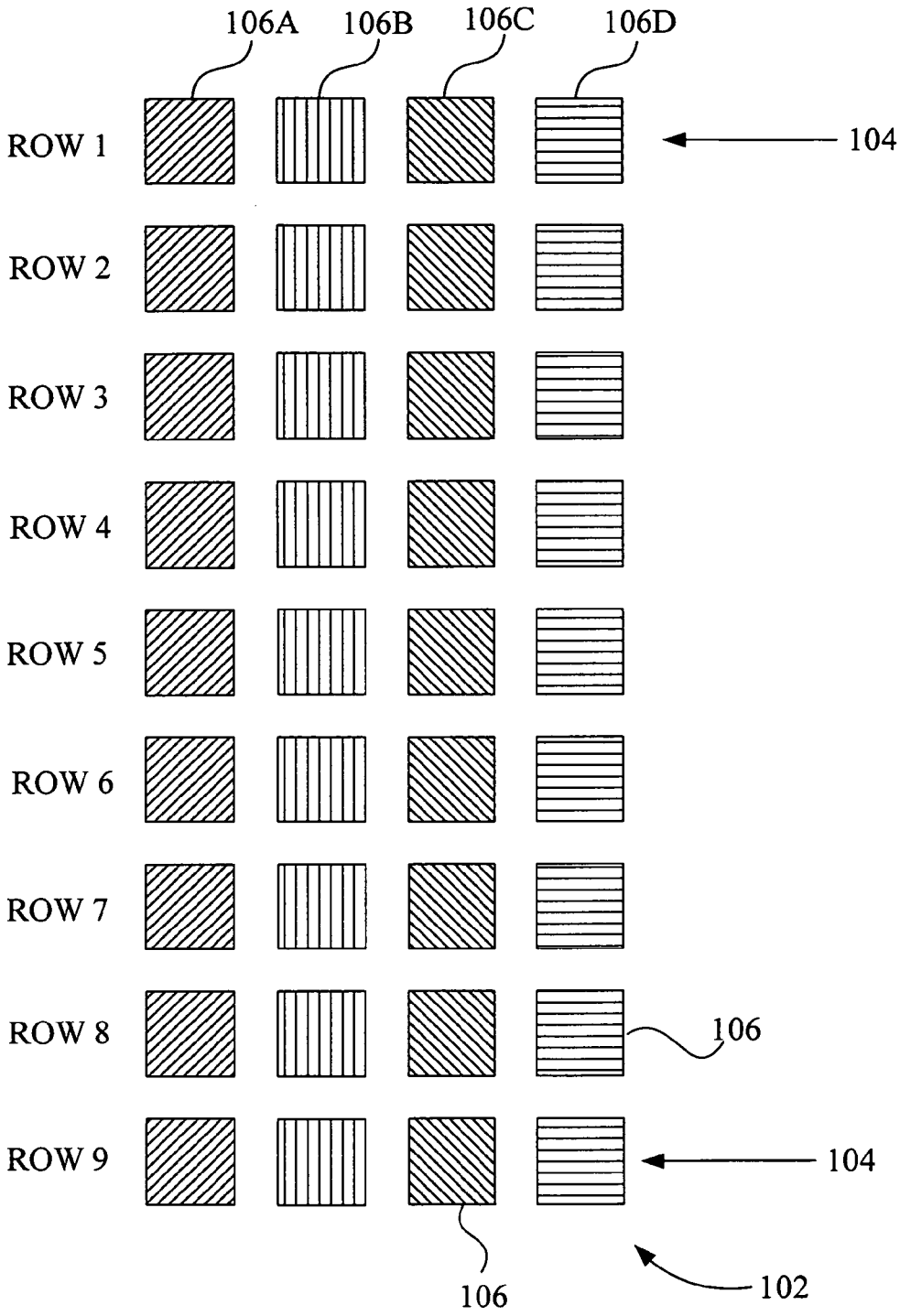
FIG. 4 depicts a plurality of rows of alignment blocks employed in performing alignment in accordance with an embodiment of the present invention.

For example, referring now to FIG. 4, a plurality of rows of alignment blocks 102, made up of rows 104 of alignment blocks 106, is depicted. Although depicted in the form of squares, the alignment blocks 106 of the present invention are not so limited. Rather the alignment blocks may take any convenient shape without departing from the scope of the present invention, so long as there is sufficient printed area in each block that may be measured for luminance, graininess, and/or reflectivity. Nine exemplary rows 104 are printed in the present embodiment, designated as rows 1-9 in FIG. 4. Each row 104 includes at least two chromatic alignment blocks 106 that are printed using primary color inks, for example, selected from cyan, magenta, and yellow. In the present embodiment, each alignment block 106 in each row 104 is a different color, as indicated by the different cross-hatching of FIG. 4. For example, alignment block 106A is primarily blue in color, the color being represented by the diagonal cross-hatch having a positive slope, alignment block 106B is primarily red in color, the color being represented by the vertical cross-hatch, alignment block 106C is primarily green in color, the color being represented by the diagonal cross-hatch having a negative slope, and alignment block 106D is primarily gray, as represented by the horizontal cross-hatch having a negative slope.

Each of chromatic alignment blocks 106A-106C are printed using at least two inks, for example, at least cyan and magenta inks are used to print alignment block 106A, at least magenta and yellow inks are used to print alignment block 106B, and at least cyan and yellow inks are used to print alignment block 106C. In the present embodiment, achromatic alignment block 106D is printed using cyan, magenta, and yellow inks, although in another embodiment, only black ink may be used. Also, in the present embodiment, the alignment blocks include information on all colorants, e.g., are printed using cyan, magenta, and yellow inks, using information on the most sensitive combinations of colorants to the human eye based on psychometric studies and corresponding empirical data to determine the amounts of each ink used in printing the alignment blocks. For example by having an experimental group of observers not skilled in the art rank the graininess of images of varying colors, a determination as to which colors are most sensitive to the eye of average observer may be made, which determines the colors that are used to print the alignment blocks. Thus, alignment blocks 106 of the present invention are bidirectionally printed using combinations of colorants, including colorant amounts, that are determined based on psychometric data.

Rows 104 of alignment blocks 106 are printed bidirectionally using a forward pass and a reverse pass, i.e., some of the dots are ejected while printhead 34 is translating in forward scan direction 62, and others are printed while printhead 34 is translating in reverse scan direction 64. In printing rows 104 in keeping with embodiments of the present invention, the bidirectional offset that is different for each row may be either a forward pass bidirectional offset or a reverse pass bidirectional offset. A forward pass bidirectional offset may be used to alter the position of dots printed on print media sheet 30 during a forward pass, whereas a reverse pass bidirectional offset may be used to alter the position of dots printed on print media sheet 30 during a reverse pass. In the present embodiment, the bidirectional offset that is different for each row is a reverse pass bidirectional offset. In addition, the bidirectional offset that is different for each row is also a horizontal bidirectional offset, which may be used to alter the horizontal position of the dots printed during the respective pass Thus, the reverse pass for each row 104 is printed using a different horizontal bidirectional offset.

The horizontal bidirectional offset is incremented as between rows 104 from one side of a nominal value to the other side, wherein the nominal value represents a default horizontal bidirectional offset, normalized herein as a zero point. For example, in the present embodiment, the horizontal bidirectional offset is incremented from −8/4800" to 8/4800" in increments of 2/4800". Thus the first row is printed using a horizontal bidirectional offset of −8/4800" for the reverse pass, the next row is printed using a horizontal bidirectional offset of −6/4800" for the reverse pass, etc., and the last row is printed using a horizontal bidirectional offset of 8/4800" for the reverse pass. Because the horizontal bidirectional offset is different for each row, the amount of white space between the printed dots that form the alignment blocks is different for each row, and the amount of overlap of the printed dots that form the alignment blocks in each row is different for each row. Thus, the luminance, graininess, and reflectivity accordingly vary from one row to the next.

In another embodiment, it is contemplated that the reverse pass of each row 104 is printed using a different vertical bidirectional offset so as to perform a vertical bidirectional alignment in accordance with the present invention, e.g., wherein each bidirectional offset of the plurality of bidirectional offsets used to print rows 104 is a different vertical bidirectional offset. For example, in such an embodiment, the print media would be indexed in the reverse pass so as to place the print media in a different vertical position for the reverse pass than for the forward pass. The difference in vertical position of the print media as between the forward and reverse passes would vary with each row 104 in a similar fashion to that described above with respect to varying the horizontal bidirectional offset, yielding similar variations in white space between the dots forming the printed alignment blocks and overlap of the dots forming the printed alignment blocks.

At step S202, each row of alignment blocks is optically measured to obtain measurement data using sensor 29, which provides an output signal representing reflectance data to controller 25, yielding a measure of the uniformity of each of the alignment blocks 106 of each row 104.

At step S204, statistical data values are determined for each row based on the measurement data. In particular, step S204 includes, for each row 104, calculating the mean (average) and standard deviation of the reflectance data output by sensor 29, and then dividing the standard deviation by the mean. Thus, for each row 104, the statistical data values include a mean and standard deviation of reflectance data for the row, as well as a value representing the standard deviation of reflectance data divided by an average of reflectance data for the row.

At step S206, the statistical data values are compared to determine which row 104 has the lowest value of the standard deviation divided by the mean as determined in step S204.

In another embodiment, however, the statistical data values are compared to determine which row has the lowest difference between its mean reflectance data and a predetermined value, and to determine which row has the lowest standard deviation.

At step S208, a respective bidirectional offset of the plurality of bidirectional offsets corresponding to the row 104 having the lowest statistical data value of plurality of rows 104 is determined to be the most suitable bidirectional offset, and is applied by controller 25 to align printhead 34 for printing with printhead 34. In other words, the bidirectional offset that was used to print the row 104 having the lowest value of the standard deviation divided by the mean, of the reflectance data, is the bidirectional offset that will be employed to align and print using printhead 34.

In another embodiment, the bidirectional offset used to print the row 104 having the lowest difference between its mean reflectance data and a predetermined value and the lowest standard deviation will be employed to align and print using printhead 34.

Figure 5:
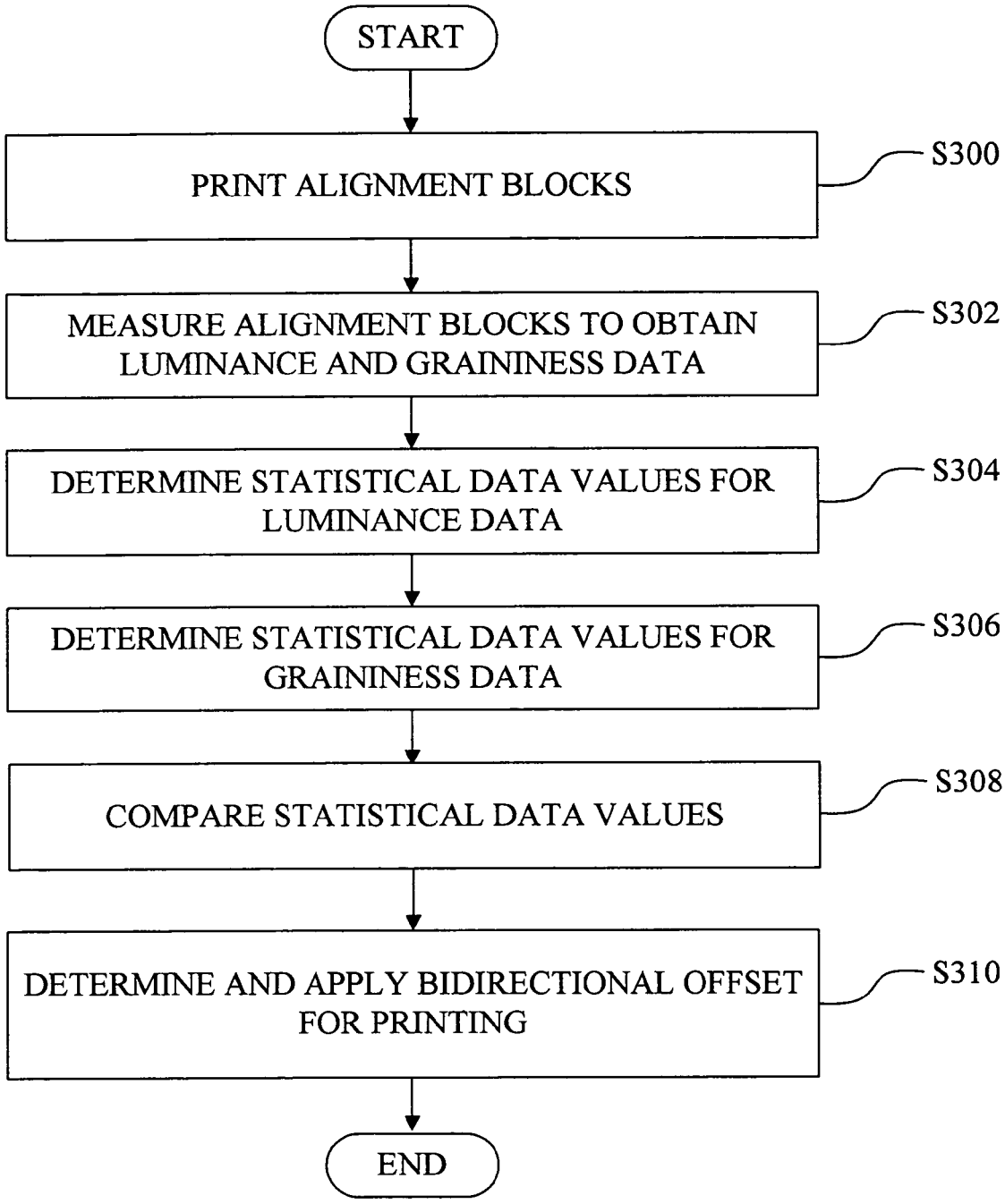
FIG. 5 is a flowchart depicting another method of performing alignment for printing with a printhead in accordance with an embodiment of the present invention.

Referring now to FIG. 5, another method of performing alignment for printing with printhead 34 in accordance with an embodiment of the present invention is depicted in the form of a flowchart, as with respect to steps S300-S310. Controller 25 executes instructions to perform each step, as follows.

At step S300, plurality of rows of alignment blocks 102 are bidirectionally printed in the same manner as set forth above with respect to the embodiment of step S200. The description of printing plurality of rows of alignment blocks 102 set forth above with respect to step S200 applies equally to step S300.

At step S302, each row of alignment blocks is optically measured to obtain measurement data using scanner portion 19, which ultimately provides to controller 25 the luminance and graininess data pertaining to alignment blocks 106 of each row 104. Alternatively, however, it is contemplated that gray level data or green channel data may be employed instead of the luminance data.

At step S304, luminance statistical data values are determined for each row based on the measurement data. In particular, step S304 includes, for each row 104, calculating the mean (average) and standard deviation of the luminance data obtained by scanner portion 19, and then dividing the standard deviation by the mean. Thus, for each row 104, the statistical data values include a mean and standard deviation of luminance data, as well as a value representing the standard deviation of luminance divided by an average luminance for each row.

At step S306, graininess statistical data values are determined for each row based on the measurement data. In particular, step S304 includes calculating the value of the average graininess associated with each alignment block 106 of each row 104. The graininess calculation is performed, for example, by taking a Fourier transformation of the placement of the dots in the scanned data from each alignment block 106 of each row 104 to obtain frequency domain data. The obtained frequency data is then weighed according to a known contrast sensitivity curve to yield a grain scale. In the present embodiment, the graininess value is calculated based on psychometric data. For example, the graininess calculation is tuned to match the response of an average person, based on psychometric data. The psychometric data may be obtained by having an experimental group of observers not skilled in the art rank the graininess of color patches having colors similar to those used in alignment blocks 106, which, as set forth previously, combinations of colorants to which the average human eye is sensitive.

At step S308, the statistical data values are compared to determine which row 104 has the lowest value of the luminance standard deviation divided by the mean as determined in step S304, and the lowest average graininess as determined in step S306.

Figure 6:
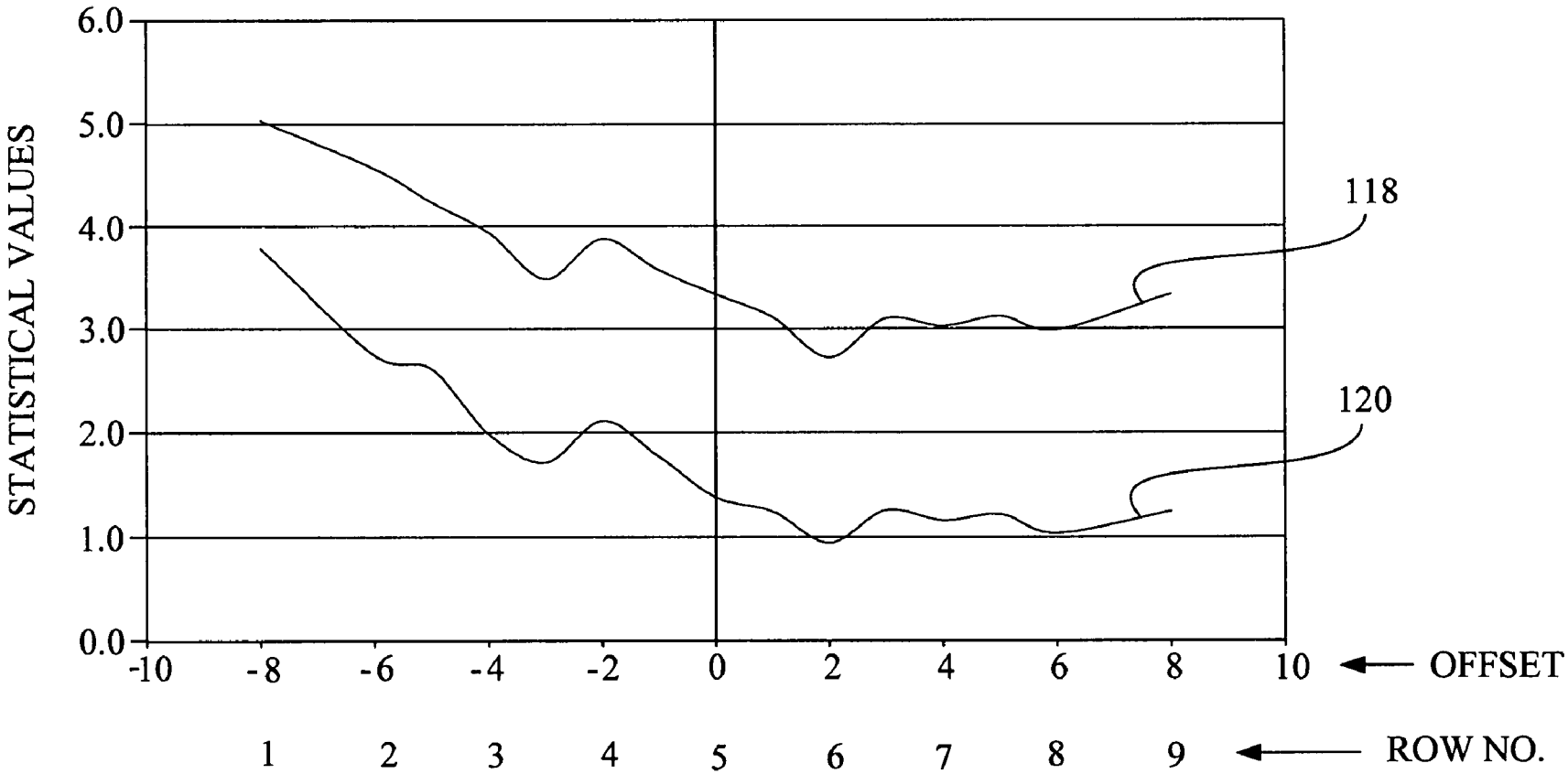
FIG. 6 depicts a plot of luminance and graininess data employed in performing alignment in accordance with the embodiment of FIG. 5.

For example, referring now to FIG. 6, the statistical data values determined in steps S304 and S306 are plotted. The abscissa of FIG. 6 represents the bidirectional offset used to print head row 104 (in increments of 1/4800 inch in the present example), as well as the row number, one through nine, (e.g., from FIG. 4), whereas the ordinate represents a normalized statistical data value. A curve 118 depicts the standard deviation of luminance divided by the mean luminance for each row 104, whereas a curve 120 depicts the average graininess for each row 104. From FIG. 6, it is seen that the sixth row 104 has the lowest the lowest value of the luminance standard deviation divided by the mean and also the lowest average graininess, and that the corresponding bidirectional offset is 2/4800".

Referring again to FIG. 5, at step S310, a respective bidirectional offset of the plurality of bidirectional offsets corresponding to the row 104 having the lowest statistical data value of plurality of rows 104 is determined to be the most suitable bidirectional offset, and is applied by controller 25 to align printhead 34 for printing with printhead 34. In the present example, the lowest statistical value is associated with the sixth row 104. Thus, the bidirectional offset used to print the sixth row 104, which is 2/4800", will be employed to align and print using printhead 34, replacing the default bidirectional offset value.

While this invention has been described with respect to exemplary embodiments, it will be recognized that the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of performing alignment for printing with a printhead, comprising:

bidirectionally printing a plurality of rows of alignment blocks, wherein a bidirectional offset of a plurality of bidirectional offsets is different for each row of said alignment blocks;

optically measuring said each row to obtain measurement data;

determining a statistical data value for said each row based on said measurement data; and applying a respective bidirectional offset of said plurality of bidirectional offsets corresponding to a row having the lowest statistical data value of said plurality of rows to align said printhead for printing with said printhead.

2. The method of claim 1, wherein said each row of said alignment blocks includes at least two chromatic alignment blocks.

3. The method of claim 2, wherein said at least two chromatic alignment blocks are printed using at least two primary color inks.

4. The method of claim 1, wherein said statistical data value includes a graininess value associated with each alignment block of said alignment blocks.

5. The method of claim 4, wherein said graininess value is calculated based on psychometric data.

6. The method of claim 4, wherein said statistical data value includes a standard deviation of luminance for said each row.

7. The method of claim 1, wherein said statistical value includes a standard deviation of luminance for said each row.

8. The method of claim 7, wherein said statistical value includes said standard deviation of luminance divided by an average luminance for said each row.

9. The method of claim 1, wherein said statistical value includes a standard deviation of reflectance data for said each row.

10. The method of claim 9, wherein said statistical value includes said standard deviation of reflectance data divided by an average of reflectance data for said each row.

11. The method of claim 1, wherein each said bidirectional offset of said plurality of bidirectional offsets is a horizontal bidirectional offset.

12. The method of claim 1, wherein each said bidirectional offset of said plurality of bidirectional offsets is a vertical bidirectional offset.

13. The method of claim 1, wherein said bidirectional offset of said plurality of bidirectional offsets that is different for each row is one of a forward pass bidirectional offset and a reverse pass bidirectional offset.

14. The method of claim 1, wherein said alignment blocks are printed using combinations of colorants that are determined based on psychometric data.

15. An imaging apparatus configured for performing alignment for printing with a printhead of said imaging apparatus, comprising:

a printer portion configured to mount said printhead;

at least one of a scanner portion and a sensor; and a controller communicatively coupled to said printer portion and said at least one of said scanner portion and said sensor, said controller being configured to execute instructions for:

bidirectionally printing a plurality of rows of alignment blocks using said printhead, wherein a bidirectional offset of a plurality of bidirectional offsets is different for each row of said alignment blocks;

optically measuring said each row using said at least one of said scanner portion and said sensor to obtain measurement data;

determining a statistical data value for said each row based on said measurement data; and applying a respective bidirectional offset of said plurality of bidirectional offsets corresponding to a row having the lowest statistical data value of said plurality of rows to align said printhead for printing with said printhead.

16. The imaging apparatus of claim 15, wherein said each row of said alignment blocks includes at least two chromatic alignment blocks.

17. The imaging apparatus of claim 16, wherein said at least two chromatic alignment blocks are printed using at least two primary color inks.

18. The imaging apparatus of claim 15, wherein said statistical data value includes a graininess value associated with each alignment block of said alignment blocks.

19. The imaging apparatus of claim 18, wherein said graininess value is calculated based on psychometric data.

20. The imaging apparatus of claim 18, wherein said statistical data value includes a standard deviation of luminance for said each row.

21. The imaging apparatus of claim 15, wherein said statistical value includes a standard deviation of luminance for said each row.

22. The imaging apparatus of claim 21, wherein said statistical value includes said standard deviation of luminance divided by an average luminance for said each row.

23. The imaging apparatus of claim 15, wherein said statistical value includes a standard deviation of reflectance data for said each row.

24. The imaging apparatus of claim 23, wherein said statistical value includes said standard deviation of reflectance data divided by an average of reflectance data for said each row.

25. The imaging apparatus of claim 15, wherein each said bidirectional offset of said plurality of bidirectional offsets is a horizontal bidirectional offset.

26. The imaging apparatus of claim 15, wherein each said bidirectional offset of said plurality of bidirectional offsets is a vertical bidirectional offset.

27. The imaging apparatus of claim 15, wherein said bidirectional offset of said plurality of bidirectional offsets that is different for each row is one of a forward pass bidirectional offset and a reverse pass bidirectional offset.

28. The imaging apparatus of claim 15, said printhead being configured to print using a plurality of colorants, wherein said alignment blocks are bidirectionally printed using combinations of colorants of said plurality of colorants that are determined based on psychometric data.

* * * * *